US006413653B1

(12) United States Patent
Araki et al.

(10) Patent No.: US 6,413,653 B1
(45) Date of Patent: Jul. 2, 2002

(54) PERSONAL ORNAMENT COVERED WITH COLORED COATING AND PROCESS FOR PRODUCING THE SAME

(75) Inventors: Takeshi Araki; Takeshi Inoue, both of Tanashi (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/762,192

(22) PCT Filed: Jul. 6, 1999

(86) PCT No.: PCT/JP99/03634

§ 371 (c)(1),
(2), (4) Date: Feb. 2, 2001

(87) PCT Pub. No.: WO00/08233

PCT Pub. Date: Feb. 17, 2000

(30) Foreign Application Priority Data

Aug. 3, 1998 (JP) ..... 10-219100

(51) Int. Cl.[7] ..... B32B 15/04; B32B 5/00

(52) U.S. Cl. ..... 428/627; 428/655; 428/658; 428/674; 428/675; 428/680

(58) Field of Search ..... 428/655, 658, 428/674, 675, 680, 627

(56) References Cited

FOREIGN PATENT DOCUMENTS

GB 2173218 3/1986
JP 4-304386 * 10/1992
JP 6-002935 1/1994

* cited by examiner

*Primary Examiner*—Deborah Jones
*Assistant Examiner*—Andrew T Piziali
(74) *Attorney, Agent, or Firm*—Webb Ziesenheim Logsdon Orkin & Hanson, P.C.

(57) ABSTRACT

A personal ornament having its surface covered with a colored coating, the colored coating formed by dry-plating, which personal ornament comprises a basis material for personal ornament, composed of a copper alloy or zinc; a nickel plating layer on a surface of the basis material, or a nickel plating layer on a surface of a copper plating layer on a surface of the basis material; an amorphous nickel/phosphorus alloy plating layer on a surface of the nickel plating layer; and at least one colored coating layer on a surface of the amorphous nickel/phosphorus alloy plating layer, the colored coating layer formed by dry-plating, and wherein the amorphous nickel/phosphorus alloy plating layer has a phosphorus content of 11 to 16% by weight. As compared with conventional personal ornaments, this personal ornament is furnished with a colored coating having excellent corrosion resistance and can be produced at low cost.

33 Claims, 1 Drawing Sheet

PERSONAL ORNAMENT COVERED WITH COLORED COATING AND PROCESS FOR PRODUCING THE SAME

TECHNICAL FIELD

The present invention relates to a personal ornament wherein a basis material composed of a copper alloy or zinc is covered with, as an outermost layer, a colored coating of, for example, titanium nitride formed by dry-plating such as the ion plating process, and further relates to a process for producing the personal ornament.

BACKGROUND OF THE INVENTION

Personal ornaments wherein a basis material composed of a copper alloy or zinc is covered with, as an outermost layer, a colored coating of, for example, titanium nitride formed by the ion plating process are known. For example, Japanese Patent Publication No. 6(1994)-2935 whose applicant is identical with that of the present application discloses a personal ornament with a colored surface, comprising a personal ornament basis material composed of a copper alloy, a 1 to 10 $\mu$m thick nickel layer formed as an undercoat layer on a surface thereof by electroplating, a 0.5 to 5 $\mu$m thick palladium or palladium alloy (for example, palladium/nickel) layer formed on the nickel layer by electroplating and a colored coating layer of, for example, titanium nitride formed on the palladium or palladium alloy layer by the ion plating process. This personal ornament, because it is not needed to thicken the nickel layer, is free from pattern unsharpness and sagging attributed to thick plating, exhibits an appearance of superior quality and is excellent in corrosion resistance.

However, this personal ornament, although involving no practical problem, poses a cost problem due to the inclusion of the palladium or palladium/nickel layer. The price of palladium (Pd) as a constituent of the layer is recently very high, thereby extremely increasing the production cost of the personal ornament. For example, the price of palladium was about 500 yen/g in 1997, but currently (1998) it is as high as 1400 yen/g. Moreover, ammonia gas emitted at the electroplating conducted for the formation of the palladium/nickel layer is likely to be detrimental to other cyanide using platings (14 or 18 karat Au/Ag plating). Further, the palladium/nickel layer tends to occlude hydrogen, so that cracking of the palladium/nickel layer is likely to occur resulting unfavorable lowering of the adhesion to the colored coating layer and lowering of the durability (corrosion resistance) of the palladium/nickel layer.

Further, Japanese Patent Laid-open Publication No. 4(1992)-304386 whose applicant is identical with that of the present application discloses a basis material composed of a material of low melting point such as brass, german silver (nickel silver or argentan) or zinc die cast, a nickel layer formed as an undercoat layer on a surface of the basis material by wet-plating, a nickel/phosphorus alloy layer formed directly on the nickel layer by electroplating and a dry plating layer (colored coating layer) formed on the nickel/phosphorus alloy layer by dry-plating. With respect to this metal member, the amount of ammonia gas emitted at the electroplating conducted for the formation of the nickel/phosphorus alloy layer is so small that the ammonia gas is substantially free from adversely affecting other platings (ion plating process (dry-plating)). Also, the nickel/phosphorus alloy layer substantially does not occlude hydrogen and is free from cracking, so that there is no danger of lowering of the adhesion to the dry plating layer (colored coating layer) and lowering of the durability of the nickel/phosphorus alloy layer. In particular, the metal member described in Example 1 of Japanese Patent Laid-open Publication No. 4(1992)-304386, because of the formation of a nickel/phosphorus alloy layer having a phosphorus content of about 10%, is excellent in durability and poses no practical problem at all. Although not described in the above Japanese Patent Laid-open Publication No. 4(1992)-304386, the nickel/phosphorus alloy layer of Example 1 thereof is formed by electroplating at a current density (Dk) of 5 A/dm$^2$ at 55° C. in a pH 4.0 acid plating solution which contains nickel sulfate in an amount, in terms of nickel atom, of 50 g/lit., nickel chloride in an amount, in terms of nickel atom, of 15 g/lit. and sodium hypophosphite in an amount, in terms of phosphorus atom, of 35 g/lit. Electroplating in this plating solution under the above plating conditions for a prolonged current passage time, however, does not lead to formation of an amorphous nickel/phosphorus alloy layer having a phosphorus content of 11% by weight or more.

The inventors have conducted extensive and intensive studies with a view toward obtaining a personal ornament of high grade having a corrosion resistance greater than those of personal ornaments and metal members disclosed in the above publications without the use of expensive palladium. As a result, it has been found that the following personal ornament produced as described below (1) or (2) includes an amorphous nickel/phosphorus alloy plating layer whose phosphorus content is in the range of 11 to 16% by weight and has a corrosion resistance greater than those of personal ornaments and metal members disclosed in the above publications. The present invention has been completed on the basis of this finding.

Personal ornament (1): This is produced by the following process. First, a nickel plating layer of 1 to 5 $\mu$m thickness is formed by electroplating on a surface of a basis material for personal ornament composed of a copper alloy or zinc. Alternatively, a copper plating layer of 10 to 15 $\mu$m thickness is formed on the basis material by electroplating, and a surface of the copper plating layer is covered by electroplating with a nickel plating layer of 1 to 10 $\mu$m thickness. Subsequently, an amorphous nickel/phosphorus alloy coating layer of 3 to 10 $\mu$m thickness (phosphorus content: 11 to 16% by weight) is formed on a surface of the nickel plating layer by electroplating at a current density (Dk) of 1 to 3 A/dm$^2$, at 50 to 60° C., in an acid plating solution of pH 3.0 to 3.5 which contains nickel sulfate in an amount, in terms of nickel atom, of 15 to 70 g/lit., sodium hypophosphite in an amount, in terms of phosphorus atom, of 10 to 50 g/lit., an electric conductive salt (ammonium chloride) in an amount of 50 to 90 g/lit., a pH buffer in an amount of 20 to 50 g/lit. and a completing agent in an amount of 5 to 30 g/lit. Finally, a 0.1 to 2 $\mu$m thick colored coating layer is formed by dry-plating on a surface of the amorphous nickel/phosphorus alloy plating layer.

Personal ornament (2): This is produced by the following process. First, a nickel plating layer of 1 to 10 $\mu$m thickness is formed by electroplating on a surface of a basis material for personal ornament composed of a copper alloy or zinc. Alternatively, a copper plating layer of 10 to 15 $\mu$m thickness is formed on the basis material by electroplating, and thereafter a surface of the copper plating layer is covered by electroplating with a nickel plating layer of 1 to 10 $\mu$m thickness. Subsequently, an amorphous nickel/phosphorus alloy coating layer layer of 3 to 10 $\mu$m thickness (phosphorus content: 11 to 16% by weight) is formed on a surface of the nickel plating (coating) by electroless plating in a plating solution which contains a nickel salt such as nickel sulfate in an amount, in terms of nickel atom, of 1 to 15 g/lit., sodium hypophosphite (reducing agent) in an amount, in terms of phosphorus atom, of 5 to 30 g/lit., a complexing agent, a buffer and a pH regulator, at 85 to 95° C. and pH of 3.0 to 4.5. Alternatively, the amorphous nickel/phosphorus alloy coating layer of 3 to 10 μm thickness (phosphorus content: 11 to 16% by weight) is formed by first electroplating by passing current at a density (Dk) of 0.5 to 1.0 $A/dm^2$ for a period of 5 to 30 sec through the above plating solution whose pH is in the range of 3.0 to 4.5 and whose temperature is in the range of 50 to 95° C. and thereafter electroless plating in the plating solution whose pH is in the range of 3.0 to 4.5 and whose temperature is in the range of 85 to 95° C. Finally, a colored coating layer of 0.1 to 2 μm thickness is formed by dry-plating on a surface of the amorphous nickel/phosphorus alloy plating layer.

Accordingly, an object of the present invention is to provide a cheap personal ornament having a corrosion resistance greater than those of personal ornaments and metal members disclosed in the above publications without the use of expensive palladium and to provide a process for producing the same.

SUMMARY OF THE INVENTION

According to one essential aspect o f the present invention, there is provided a personal ornament having its surface covered with a colored coating, the colored coating formed by dry-plating, which personal ornament comprises:

a basis material for personal ornament, composed of a copper alloy or zinc, a nickel plating (coating) layer on a surface of the basis material, or a nickel plating layer on a surface of a copper plating layer on a surface of the basis material, an amorphous nickel/phosphorus alloy plating layer on a surface of the nickel plating layer, and at least one colored coating layer on a surface of the amorphous nickel/phosphorus alloy plating layer, the colored coating layer formed by dry-plating, the amorphous nickel/phosphorus alloy plating layer having a phosphorus content of 11 to 16% by weight.

As one form (the first form) of the personal ornament covered with a colored coating according to the present invention, there is provided a personal ornament having its surface covered with a colored coating, the colored coating formed by dry-plating, which personal ornament comprises:

a basis material for personal ornament, composed of a copper alloy or zinc, a nickel plating layer on a surface of the basis material, or a nickel plating layer superimposed on a surface of a copper plating layer on a surface of the basis material, an amorphous nickel/phosphorus alloy plating layer on a surface of the nickel plating layer, the amorphous nickel/phosphorus alloy plating layer formed in a plating solution which contains nickel sulfate in an amount, in terms of nickel atom, of 15 to 70 g/lit., sodium hypophosphite in an amount, in terms of phosphorus atom, of 10 to 50 g/lit., an electric conductive salt in an amount of 50 to 90 g/lit., a pH buffer in an amount of 20 to 50 g/lit. and a complexing agent in an amount of 5 to 30 g/lit., and at least one colored coating layer on a surface of the amorphous nickel/phosphorus alloy plating layer, the colored coating layer formed by dry-plating, the amorphous nickel/phosphorus alloy plating layer having a phosphorus content of 11 to 16% by weight.

The above amorphous nickel/phosphorus alloy plating layer may be one obtained by electroplating at a current density (Dk) of 1 to 3 $A/dm^2$ and temperature of in the range of 50 to 60° C. in the above plating solution whose pH is in the range of 3.0 to 3.5.

The above complexing agent may be at least one member selected from the group consisting of citric acid, tartaric acid, malonic acid, malic acid, glycine, gluconic acid and salts thereof.

As another form (the second form) of the personal ornament covered with a colored coating according to the present invention, there is provided a personal ornament having its surface covered with a colored coating, the colored coating formed by dry-plating, which personal ornament comprises:

a basis material for personal ornament, composed of a copper alloy or zinc, a nickel plating layer on a surface of the basis material, or a nickel plating layer on a surface of a copper plating layer on a surface of the basis material, an amorphous nickel/phosphorus alloy plating layer on a surface of the nickel plating layer, the amorphous nickel/phosphorus alloy plating layer formed by electroless plating in a plating solution which contains a nickel salt in an amount, in terms of nickel atom, of 1 to 15 g/lit., sodium hypophosphite (reducing agent) in an amount, in terms of phosphorus atom, of 5 to 30 g/lit., a complexing agent, a buffer and a pH regulator, or by first electroplating in the plating solution and thereafter electroless plating in the same plating solution, and at least one colored coating layer on a surface of the amorphous nickel/phosphorus alloy plating layer, the colored coating layer formed by dry-plating, the amorphous nickel/phosphorus alloy plating layer having a phosphorus content of 11 to 16% by weight.

The plating solution for use in the electroless plating or in the electroplating followed by the electroless plating may have a pH of 3.0 to 4.5 and a temperature of 50 to 95° C.

The above colored coating layer may be at least one layer selected from the group consisting of a metal coating layer, a coating layer of metal nitride, a coating layer of metal carbide, a coating layer of metal oxide, a coating layer of metal carbonitride, a coating layer of metal oxynitride, a coating layer of metal oxycarbide and a coating layer of metal oxycarbonitride.

In the personal ornament covered with a colored coating according to the present invention, the nickel plating layer may have a thickness of 1 to 10 μm, the amorphous nickel/phosphorus alloy plating layer may have a thickness of 3 to 10 μm, and the colored coating layer may have a thickness (total thickness in the event of a plurality of colored coating layers) of 0.1 to 2 μm.

For obtaining the first form of personal ornament covered with a colored coating according to the present invention, there is provided a process for producing a personal ornament having its surface covered with a colored coating , the colored coating formed by dry-plating, which process comprises the steps of:

electroplating a surface of a basis material for personal ornament composed of a copper alloy or zinc to thereby form a nickel plating layer on the surface, or first electroplating a surface of the basis material to thereby form a copper plating layer on the surface and thereafter electroplating a surface of the copper plating layer to thereby form a nickel plating layer on the surface of the copper plating layer, electroplating a surface of the nickel plating layer in a plating solution which contains nickel sulfate in an amount, in terms of nickel atom, of 15 to 70 g/lit., sodium hypophosphite in an amount, in terms of phosphorus atom, of 10 to 50 g/lit., an electric conductive salt in an amount of 50 to 90 g/lit., a pH buffer in an amount of 20 to 50 g/lit. and a completing agent in an amount of 5 to 30 g/lit. to thereby form on the surface of the nickel plating layer an amorphous nickel/phosphorus alloy plating layer having a phosphorus content of 11 to 16% by weight, and subjecting a surface of the amorphous nickel/phosphorus alloy plating layer to dry-plating so that at least one colored coating layer is formed on the surface.

The above formation of the amorphous nickel/phosphorus alloy plating layer may be performed at a current density (Dk) of 1 to 3 A/dm$^2$ in the plating solution whose temperature is in the range of 50 to 60° C.

The above complexing agent may be at least one member selected from the group consisting of citric acid, tartaric acid, malonic acid, malic acid, glycine, gluconic acid and salts thereof.

For obtaining the second form of personal ornament covered with a colored coating according to the present invention, there is provided a process for producing a personal ornament having its surface covered with a colored coating formed by dry-plating, which process comprises the steps of:

electroplating a surface of a basis material for personal ornament composed of a copper alloy or zinc to thereby form a nickel plating layer on the surface, or first electroplating a surface of the basis material to thereby form a copper plating layer on the surface and thereafter electroplating a surface of the copper plating layer to thereby form a nickel plating layer on the surface of the copper plating layer, electroless plating a surface of the nickel plating layer in a plating solution which contains a nickel salt in an amount, in terms of nickel atom, of 1 to 15 g/lit., sodium hypophosphite (reducing agent) in an amount, in terms of phosphorus atom, of 5 to 30 g/lit., a completing agent, a buffer and a pH regulator, or first electroplating a surface of the nickel plating layer in the plating solution and thereafter electroless plating the surface in the same plating solution, to thereby form on the surface of the nickel plating layer an amorphous nickel/phosphorus alloy plating layer having a phosphorus content of 11 to 16% by weight, and subjecting a surface of the amorphous nickel/phosphorus alloy plating layer to dry-plating so that at least one colored coating layer is formed on the surface.

The above amorphous nickel/phosphorus alloy plating layer may be formed by electroless plating in the plating solution whose pH is in the range of 3.0 to 4.5 and temperature is in the range of 85 to 95° C. Alternatively, the amorphous nickel/phosphorus alloy plating layer may be formed by first electroplating by passing current at a density (Dk) of 0.5 to 3.0 A/dm$^2$ for a period of 5 to 30 sec through the plating solution whose pH is in the range of 3.0 to 4.5 and temperature is in the range of 50 to 95° C. and thereafter electroless plating in the plating solution.

In the personal ornament obtained by the process for producing a personal ornament covered with a colored coating according to the present invention, the phosphorus content of the amorphous nickel/phosphorus alloy coating layer is in the range of 11 to 16% by weight.

The above colored coating layer may be at least one layer selected from the group consisting of a metal coating layer, a coating layer of metal nitride, a coating layer of metal carbide, a coating layer of metal oxide, a coating layer of metal carbonitride, a coating layer of metal oxynitride, a coating layer of metal oxycarbide and a coating layer of metal oxycarbonitride.

In the personal ornament obtained by the process for producing a personal ornament covered with a colored coating according to the present invention, the nickel plating layer may have a thickness of 1 to 10 $\mu$m, the amorphous nickel/phosphorus alloy plating layer may have a thickness of 3 to 10 $\mu$m, and the colored coating layer may have a thickness (total thickness in the event of a plurality of colored coating layers) of 0.1 to 2 $\mu$m.

DETAILED DESCRIPTION OF THE INVENTION

The personal ornament covered with a colored coating according to the present invention and the process for producing the same will be described in detail below.

Figure 1:
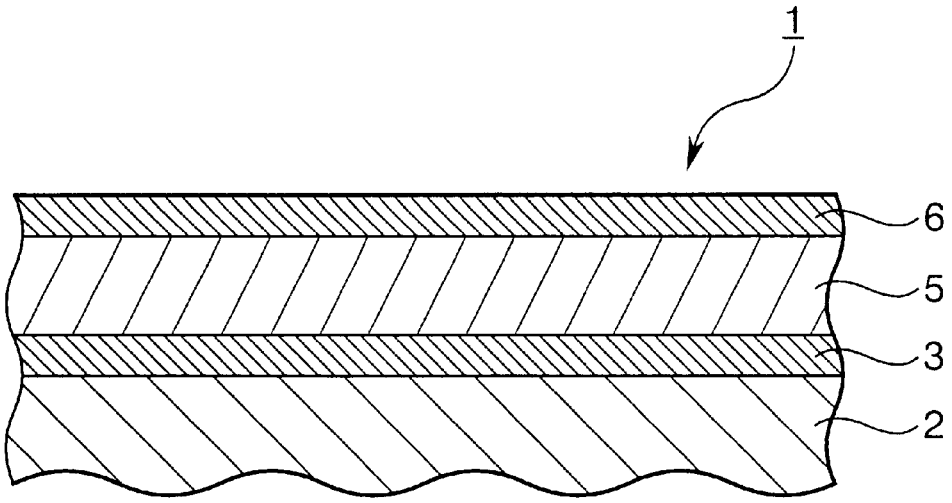
FIG. 1 is a sectional view of an essential part of one form of personal ornament according to the present invention.
Figure 2:
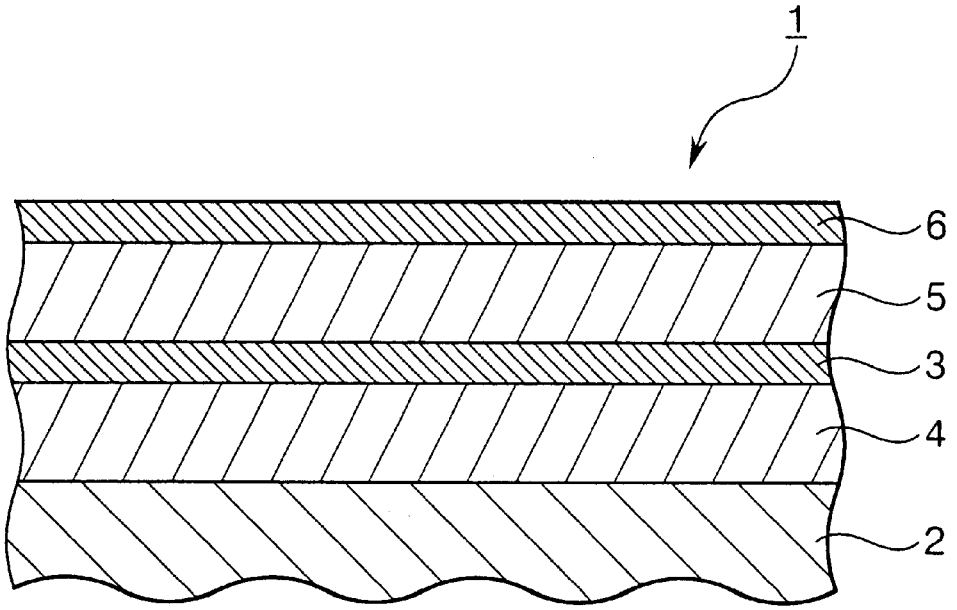
FIG. 2 is a sectional view of an essential part of another form of personal ornament according to the present invention.

The personal ornament covered with a colored coating according to the present invention, referring to FIGS. 1 and 2, is a personal ornament 1 having its surface covered with a colored coating, the colored coating formed by dry-plating, which personal ornament comprises:

a basis material for personal ornament 2, composed of a copper alloy or zinc, a nickel plating layer 3 on a surface of the basis material 2, or a nickel plating layer 3 on a surface of a copper plating layer layer 4 on a surface of the basis material 2, an amorphous nickel/phosphorus alloy plating layer 5 on a surface of the nickel plating layer 3, the amorphous nickel/phosphorus alloy plating layer 5 having a phosphorus content of 11 to 16% by weight, and at least one colored coating layer 6 on a surface of the amorphous nickel/phosphorus alloy plating layer 5, the colored coating layer formed by dry-plating.

Basis Material For Personal Ornament

The basis material for personal ornament for use in the present invention is composed of a copper alloy, such as brass or german silver (nickel silver or argentan), or zinc, such as zinc die cast. Examples of the personal ornaments (including parts) include a timepiece housing, a watch band, a watch stem, a watch back lid, a belt buckle, a finger ring, a necklace, a bracelet, an earring, a pendant, a brooch, cuff buttons, a tiepin, a badge, a medal and a spectacle.

It is preferred that the surface of the basis material for personal ornament be provided with common pretreatments.

Such pretreatments may comprise, for example, immersing the basis material for personal ornament in a commercially available immersion degreasing solution, a commercially available electrolytic degreasing solution, a cyanide solution or a solution of a mixture of sulfuric acid and a fluoride, followed by washing with water.

Copper Plating Layer and Nickel Plating Layer

When the basis material for personal ornament is composed of a copper alloy, the nickel plating layer is formed on a surface of the above basis material for personal ornament. When the basis material for personal ornament is composed of zinc, the copper plating layer and the nickel plating layer are sequentially formed on the surface of the basis material for personal ornament. Although the adherence between the basis material composed of a copper alloy and the nickel plating layer is excellent, there is cavity in the basis material composed of zinc with the result that the basis material composed of zinc cannot be fully covered with a nickel plating thereby inviting poor corrosion resistance. Therefore, in order to enhance the corrosion resistance, the copper plating layer is interposed between the basis material composed of zinc and the nickel plating layer.

In the present invention, the thickness of the nickel plating layer is generally in the range of 1 to 10 $\mu$m, preferably 3 to 5 $\mu$m. The nickel plating layer whose thickness is in these ranges exerts the effect of enhancing the brightness and corrosion resistance of the personal ornament.

The thickness of the copper plating layer is generally in the range of 10 to 15 $\mu$m.

This copper plating layer can be formed on the basis material composed of zinc by wet-plating. For example, it can be formed with the use of a plating solution containing copper ion.

The above nickel plating layer can be formed on the basis material composed of a copper alloy or on the copper plating layer by wet-plating. For example, it can be formed with the use of a plating solution containing nickel ion.

Nickel/phosphorus Alloy Plating Layer

The nickel/phosphorus alloy plating layer formed on the above nickel plating layer is composed of an amorphous nickel/phosphorus alloy. The phosphorus content of the nickel/phosphorus alloy plating layer is in the range of 11 to 16% by weight, preferably 12 to 16% by weight. The thickness of the nickel/phosphorus alloy plating layer is generally in the range of 3 to 10 $\mu$m. preferably 3 to 5 $\mu$m. In the nickel/phosphorus alloy plating layer whose phosphorus content and thickness are in the above ranges, the extent of amorphous is greater, deposited grains are finer and the number of pinholes is smaller than in the conventional nickel/phosphorus alloy plating layer whose phosphorus content is about 10% by weight. Thus, the nickel/phosphorus alloy plating layer whose phosphorus content and thickness are in the above ranges enables imparting excellent corrosion resistance to the obtained personal ornament.

First Form

As the first form of nickel/phosphorus alloy plating layer according to the present invention, there can be mentioned an amorphous nickel/phosphorus alloy plating layer having a phosphorus content of 11 to 16% by weight, formed on a surface of the nickel plating layer in a plating solution which contains nickel sulfate in an amount, in terms of nickel atom, of 15 to 70 g/lit., preferably 40 to 50 g/lit., sodium hypophosphite in an amount, in terms of phosphorus atom, of 10 to 50 g/lit., preferably 30 to 40 g/lit., an electric conductive salt in an amount of 50 to 90 g/lit., preferably 60 to 80 g/lit., a pH buffer in an amount of 20 to 50 g/lit., preferably 30 to 40 g/lit., and a complexing agent in an amount of 5 to 30 g/lit., preferably 10 to 20 g/lit.

This plating solution may be an acid solution whose pH is in the range of 3.0 to 3.5, preferably 3.0 to 3.2. The nickel/phosphorus alloy plating layer can be formed by electroplating at a current density (Dk) of 1 to 3 A/dm$^2$ in the above plating solution heated at 50 to 60° C.

The electric conductive salt for use in the present invention is, for example, ammonium chloride, sodium chloride, potassium chloride or the like. These electric conductive salts can be used either individually or in combination.

The pH buffer for use in the present invention is, for example, boric acid, formic acid, acetic acid and salts thereof. The salts can be sodium salts, such as sodium borate, and potassium salts, such as potassium acetate. These pH buffers can be used either individually or in combination.

The complexing agent for use in the present invention may be at least one member selected from the group consisting of citric acid, tartaric acid, malonic acid, malic acid, glycine, gluconic acid and salts thereof. These salts can be, for example, sodium and potassium salts of the above acids and amino acids.

In the present invention, the nickel/phosphorus alloy plating layer having a phosphorus content of 11 to 16% by weight can be formed by regulating the concentration of the hypophosphite in the plating solution, the type and concentration of the complexing agent as a constituent of the plating solution, the pH of the plating solution and the current density so as to fall within the above ranges.

Second Form

As the second form of nickel/phosphorus alloy plating layer according to the present invention, there can be mentioned:

(1) an amorphous nickel/phosphorus alloy plating layer having a phosphorus content of 11 to 16% by weight, formed on a surface of the nickel plating layer by electroless plating in a plating solution which contains a nickel salt, sodium hypophosphite, a complexing agent, a buffer and a pH regulator; and (2) an amorphous nickel/phosphorus alloy plating layer having a phosphorus content of 11 to 16% by weight, formed on a surface of the nickel plating layer by first electroplating in a plating solution which contains a nickel salt, sodium hypophosphite (reducing agent), a complexing agent, a buffer and a pH regulator and subsequently, after discontinuing current passage, electroless plating in the same plating solution.

The nickel salt as a constituent of the plating solution for use in the formation of the amorphous nickel/phosphorus alloy plating layer (1), (2) can be, for example, nickel sulfate, nickel chloride, nickel sulfamate, nickel citrate and the like. These nickel salts can be used either individually or in combination.

The above sodium hypophosphite is used as a reducing agent, and constitutes a phosphorus supply source for the formation of the nickel/phosphorus alloy plating layer.

For example, a malate, a lactate, a citrate, a tartrate or a salt of amino acid such as glycine or gluconic acid is used as the above complexing agent. Specifically, for example, any of sodium and potassium salts of malic acid, lactic acid, citric acid, tartaric acid, glycine and gluconic acid can be used. These complexing agents can be used either individually or in combination.

For example, any of sodium and potassium salts of acetic acid, succinic acid and malonic acid is used as the above buffer.

For example, sodium hydroxide, ammonium hydroxide, nickel carbonate or nickel hydroxide is used as the above pH regulator.

For example, the following plating solution can be mentioned as the plating solution which can be employed in the electroless plating conducted for the formation of the above nickel/phosphorus alloy plating layer (1), or employed in the electroplating and electroless plating conducted for the formation of the above nickel/phosphorus alloy plating layer (2). Also, the plating conditions to be complied with when the plating solution is used in the electroless plating are indicated below. The regulation of the pH value is performed with the use of sodium hydroxide, ammonium hydroxide, nickel carbonate or nickel hydroxide.

| | Usable range | Optimum range |
|---|---|---|
| <Composition of plating solution> | | |
| nickel sulfate | 1–15 g/lit. | 5–10 g/lit. |
| sodium hypophosphite | 5–30 g/lit. | 10–20 g/lit. |
| sodium malate | 15–40 g/lit. | 20–35 g/lit. |
| sodium succinate | 5–30 g/lit. | 10–25 g/lit. |
| <Plating conditions> | | |
| pH | 3.0–4.5 | |
| bath temp. | 50–95° C. | |

The above nickel/phosphorus alloy plating layer (1) is obtained by performing electroless plating in the plating solution of the above composition whose pH is in the range of 3.0 to 4.5, preferably 3.5 to 4.5, and still preferably 3.5 to 4.0, and whose temperature is in the range of 85 to 95° C.

On the other hand, the above nickel/phosphorus alloy plating layer (2) is obtained by first electroplating by passing current at a density (Dk) of 0.5 to 1.0 A/dm$^2$ for a period of 5 to 30 sec through the plating solution of the above composition whose pH value is in the range of 3.0 to 4.5, preferably 3.5 to 4.5, and still preferably 3.5 to 4.0, and whose temperature is in the range of 85 to 95° C. and subsequently, after discontinuing current passage, performing electroless plating. When electroplating is first performed, nickel is deposited on the nickel plating layer. Only subsequent discontinuation of current passage induces electroless plating. With respect to the nickel/phosphorus alloy plating layer (2), the coating layer composed of both the nickel deposited by the first electroplating and the nickel/phosphorus alloy deposited by the electroless plating is regarded as the nickel/phosphorus alloy plating layer.

The optimum plating conditions for the electroplating and electroless plating are, for example, as follows. In the electroplating, the temperature and pH value of the plating solution are preferably set at 50–60° C. and 3.0–3.5, respectively, and the current density (Dk) is preferably in the range of 1 to 3 A/dm$^2$. In the electroless plating, the temperature and pH value of the plating solution are preferably set at 85–95° C. and 3.5–4.5, respectively.

Specifically, the above electroplating followed by electroless plating can be accomplished with the use of only one plating bath or with the use of separate plating baths. When the electroplating and the electroless plating are performed in one and the same plating bath, for example, electroplating is carried out in the plating bath heated at 50 to 60° C., and thereafter a pipe heater is placed in the plating bath to thereby rapidly increase the temperature of the plating bath to 85–95° C., at which the electroless plating is effected. On the other hand, when the electroplating and the electroless plating are performed in separate plating baths, for example, a plating bath wherein a 50 to 60° C. plating solution is accommodated and another plating bath wherein a 85 to 95° C. plating solution is accommodated are arranged side by side. First, electroplating is carried out in the plating bath wherein a 50 to 60° C. plating solution is accommodated, and, thereafter, electroless plating is carried out in the other plating bath wherein a 85 to 95° C. plating solution is accommodated. The compositions of the plating solution for electroplating and the plating solution for electroless plating may be identical with or different from each other.

In the present invention, the nickel/phosphorus alloy plating layer having a phosphorus content of 11 to 16% by weight can be formed by regulating the hypophosphite concentration of the plating solution, the type and concentration of the complexing agent as a constituent of the plating solution and the pH value of the plating solution so as to fall within the above ranges.

With respect to the nickel/phosphorus alloy plating layer formed by the electroless plating, the uniformity of thickness is excellent, so that, even at narrow gaps between, for example, watch band pieces, the deterioration of the corrosion resistance is strikingly slight. Moreover, the nickel/phosphorus alloy plating layer formed by the electroless plating is superior, in the adherence to the neighboring nickel plating layer, to the nickel/phosphorus alloy plating layer formed by electroplating.

In accordance with the increase of the phosphorus content of the nickel/phosphorus alloy plating layer, the crystal grains of the coating layer become finer to thereby bring about a change from crystal form to amorphous form, irrespective of whether the nickel/phosphorus alloy plating layer is formed by the electroplating or the electroless plating. The change to amorphous form begins at a phosphorus content of about 8% by weight, and, at a phosphorus content exceeding 11% by weight, the nickel/phosphorus alloy plating layer becomes completely amorphous. Pinholes can be eliminated by rendering the crystal grains finer to thereby enable obtaining the nickel/phosphorus alloy plating layer having excellent corrosion resistance.

Colored Coating Layer

In the present invention, one or a plurality of colored coating layers are formed on the above nickel/phosphorus alloy plating layer.

The above colored coating layers may consist of at least one layer selected from the group consisting of a metal coating layer, a coating layer of metal nitride, a coating layer of metal carbide, a coating layer of metal oxide, a coating layer of metal carbonitride, a coating layer of metal oxynitride, a coating layer of metal oxycarbide and a coating layer of metal oxycarbonitride.

The metal for forming the metal coating layer can be, for example, any of metals belonging to Group IVA of the periodic table (titanium, zirconium and hafnium), metals belonging to Group VA of the periodic table (vanadium, niobium and tantalum), metals belonging to Group VIA of the periodic table (chromium, molybdenum and tungsten), silicon, germanium, gold, silver, copper, platinum, palladium, iron, cobalt, nickel, rhodium and ruthenium. These metals can be used either individually or in combination.

The metal nitride for forming the coating layer of metal nitride can be any of nitrides of the above metals (including alloys), for example, any of titanium nitride, zirconium nitride, hafnium nitride, vanadium nitride, niobium nitride, chromium nitride, molybdenum nitride, tantalum nitride, tungsten nitride, silicon nitride, germanium nitride, gold nitride, silver nitride, copper nitride, iron nitride, cobalt nitride and nickel nitride.

The metal carbide for forming the coating layer of metal carbide can be any of carbides of the above metals (including alloys), for example, any of titanium carbide, zirconium carbide, hafnium carbide, vanadium carbide, niobium carbide, tantalum carbide, chromium carbide, molybdenum carbide, tungsten carbide, silicon carbide, gold carbide, silver carbide, copper carbide, iron carbide, cobalt carbide and nickel carbide.

The metal oxide for forming the coating layer of metal oxide can be any of oxides of the above metals (including alloys), for example, any of titanium oxide, zirconium oxide, vanadium oxide, niobium oxide, tantalum oxide, chromium oxide, molybdenum oxide, tungsten oxide, silicon oxide, germanium oxide, gold oxide, silver oxide, copper oxide, platinum oxide, palladium oxide, iron oxide, cobalt oxide, nickel oxide and iron titanium oxide.

The metal carbonitride for forming the coating layer of metal carbonitride can be any of carbonitrides of the above metals (including alloys), for example, any of carbonitrides of titanium, zirconium, hafnium, vanadium, niobium and tantalum.

The metal oxynitride for forming the coating layer of metal oxynitride can be any of oxynitrides of the above metals (including alloys), for example, any of oxynitrides of titanium, zirconium, hafnium, vanadium, niobium and tantalum.

The metal oxycarbide for forming the coating layer of metal oxycarbide can be any of oxycarbides of the above metals (including alloys), for example, any of oxycarbides of titanium, zirconium, hafnium, vanadium, niobium and tantalum.

The metal oxycarbonitride for forming the coating layer of metal oxycarbonitride can be any of oxycarbonitrides of the above metals (including alloys), for example, any of oxycarbonitrides of titanium, zirconium, hafnium, vanadium, niobium and tantalum.

The colored coating layer of the present invention consists of one or at least two layers, and the total thickness thereof may be in the range of 0.1 to 2 $\mu$m, preferably 0.3 to 1.0 $\mu$m.

The above colored coating layer is formed by conventional dry-plating techniques. Examples of the dry-plating techniques include the ion plating method, the ion beam method, the physical vapor deposition methods (PVD) such as the sputtering method and the CVD method. Of these, the ion plating method is preferably employed.

The personal ornament covered with a colored coating according to the present invention is superior in corrosion resistance to the conventional personal ornaments and metal members. The personal ornament of the present invention, because expensive palladium is not used in the layers other than the colored coating layer, is also cheaper.

The process for producing a personal ornament according to the present invention provides the above personal ornament covered with a colored coating according to the present invention.

EXAMPLE

The present invention will be further illustrated below with reference to the following Examples, which in no way limit the scope of the invention.

The artificial sweat immersion test and ammonia gas corrosion and cracking test mentioned in the Examples and Comparative Example were carried out in the following manner.

(1) Artificial Sweat Immersion Test

Sample (personal ornament) was immersed in the following artificial sweat test solution for 48 hr, and taken out, and the surface of the sample was visually inspected.

| <Artificial sweat test solution> | |
|---|---|
| sodium chloride | 9.9 g/lit. |
| sodium sulfide | 0.8 g/lit. |
| urea | 1.7 g/lit. |
| lactic acid | 1.7 ml/lit. |
| pH (adjusted with ammonia) | 3.6 |
| temperature | 40° C. |

The sample, when the surface thereof exhibited no change irrespective of the immersion, was evaluated as "pass", while the sample, when the surface thereof exhibited a change after the immersion, was evaluated as "fail".

(2) Ammonia Gas Corrosion and Cracking Test

Sample (personal ornament) was placed in an ammonia gas atmosphere of 28% concentration for 48 hr, and taken out, and the surface of the sample was visually inspected.

The sample, when the surface thereof was free from corrosion and cracking, was evaluated as "pass", while the sample, when the surface thereof suffered from corrosion and cracking, was evaluated as "fail".

Example 1

First, a basis material for watch band, composed of brass, was immersed in a cyanide solution, taken out and washed with water.

Subsequently, the basis material for watch band was immersed in a plating solution of the following composition and electroplated under the following conditions, thereby forming a 5 $\mu$m thick nickel plating layer on a surface of the basis material.

<<Nickel Plating>>

| <Composition of plating solution> | |
|---|---|
| nickel sulfate | 300 g/lit. |
| nickel chloride | 50 g/lit. |
| boric acid | 30 g/lit. |
| <Plating conditions> | |
| pH | 4.0 |
| bath temperature | 60° C. |
| current density (Dk) | 5 A/dm$^2$. |

The obtained basis material for watch band covered with the nickel plating layer was immersed in the following plating solution of pH 3.5 at 90° C., and electroplating was carried out at a current density (Dk) of 1 A/dm$^2$ for 5 sec. Current passage was discontinued, and electroless plating was carried out. Thus, a 5 $\mu$m thick nickel/phosphorus alloy plating layer (phosphorus content: 12% by weight) was formed on a surface of the nickel plating layer. The plating solution contained a nickel salt, sodium hypophosphite, a completing agent, a buffer and a pH regulator as follows.

<<Electroless Nickel/phosphorus Plating>>

| <Composition of plating solution> | |
|---|---|
| nickel sulfate (in terms of Ni atom) | 8 g/lit. |
| sodium hypophosphite (in terms of P atom) | 15 g/lit. |
| sodium malate | 30 g/lit. |
| sodium succinate | 20 g/lit. |
| <Plating conditions> | |
| pH | 3.5 |
| bath temperature | 90° C. |

Thereafter, a 0.6 μm thick titanium nitride coating layer was formed by ion plating on a surface of the nickel/phosphorus alloy plating layer. As a result, a watch band covered with a golden colored coating was obtained.

The artificial sweat immersion test and ammonia gas corrosion and cracking test of the obtained watch band were carried out in the above manner. The results are given in Table 1.

Example 2

A 5 μm thick nickel plating layer was formed on a surface of a basis material for watch band in the same manner as in Example 1.

The obtained basis material for watch band covered with the nickel plating layer was immersed in the following plating solution, and electroplated under the following conditions. Thus, a 5 μm thick nickel/phosphorus alloy plating layer (phosphorus content: 14% by weight) was formed on a surface of the nickel plating layer.

<<Nickel/phosphorus Alloy Plating>>

| <Composition of plating solution> | |
|---|---|
| nickel sulfate (in terms of Ni atom) | 50 g/lit. |
| sodium hypophosphite (in terms of P atom) | 40 g/lit. |
| ammonium chloride (electro-conductive salt) | 70 g/lit. |
| boric acid (pH buffer) | 35 g/lit. |
| malic acid (complexing agent) | 15 g/lit. |
| <Plating conditions> | |
| pH | 3.2 |
| bath temperature | 50° C. |
| current density (Dk) | 2.5 A/dm$^2$. |

Thereafter, a 1.0 μm thick titanium carbonitride coating layer was formed by ion plating on a surface of the nickel/phosphorus alloy plating layer. As a result, a watch band covered with a gray colored coating was obtained.

The artificial sweat immersion test and ammonia gas corrosion and cracking test of the obtained watch band were carried out in the above manner. The results are given in Table 1.

Example 3

First, a basis material for timepiece housing, composed of zinc die cast, was immersed in a cyanide solution, taken out and washed with water.

Subsequently, the basis material for timepiece housing was immersed in a plating solution of the following composition and electroplated under the following conditions, thereby forming a 15 μm thick copper plating layer on a surface of the basis material.

<<Copper Plating>>

| <Composition of plating solution> | |
|---|---|
| copper pyrophosphate | 100 g/lit. |
| potassium pyrophosphate | 340 g/lit. |
| ammonium citrate | 10 g/lit. |
| ammonia | 3 g/lit. |
| <Plating conditions> | |
| pH | 8.5 |
| bath temperature | 50° C. |
| current density (Dk) | 3 A/dm$^2$. |

The resultant basis material for timepiece housing covered with the copper plating layer was immersed in a plating solution of the following composition and electroplated under the following conditions, thereby forming a 10 μm thick nickel plating layer on a surface of the copper plating layer.

<<Nickel Plating>>

| <Composition of plating solution> | |
|---|---|
| nickel sulfate | 300 g/lit. |
| nickel chloride | 50 g/lit. |
| boric acid | 30 g/lit. |
| <Plating conditions> | |
| pH | 4.0 |
| bath temperature | 60° C. |
| current density (Dk) | 5 A/dm$^2$. |

The obtained basis material for watch housing covered with the nickel plating layer was immersed in the following plating solution, and electroplated under the following conditions. Thus, a 7 μm thick nickel/phosphorus alloy plating layer (phosphorus content: 14% by weight) was formed on a surface of the nickel plating layer.

<<Nickel/phosphorus Alloy Plating>>

| <Composition of plating solution> | |
|---|---|
| nickel sulfate (in terms of Ni atom) | 40 g/lit. |
| sodium hypophosphite (in terms of P atom) | 30 g/lit. |
| ammonium chloride (electro-conductive salt) | 60 g/lit. |
| boric acid (pH buffer) | 30 g/lit. |
| malic acid (complexing agent) | 10 g/lit. |
| <Plating conditions> | |
| pH | 3.0 |
| bath temperature | 50° C. |
| current density (Dk) | 1.5 A/dm$^2$. |

Thereafter, a 1.0 μm thick titanium carbonitride coating layer was formed by ion plating on a surface of the nickel/phosphorus alloy plating layer. As a result, a timepiece housing covered with a rose colored coating was obtained.

The artificial sweat immersion test and ammonia gas corrosion and cracking test of the obtained timepiece housing were carried out in the above manner. The results are given in Table 1.

Comparative Example 1

First, a basis material for watch band, composed of brass, was immersed in a cyanide solution, taken out and washed with water.

Subsequently, the basis material for watch band was immersed in a plating solution of the following composition and electroplated under the following conditions, thereby forming a 5 μm thick nickel plating layer on a surface of the basis material.

<<Nickel Plating>>

| <Composition of plating solution> | |
|---|---|
| nickel sulfate | 300 g/lit. |
| nickel chloride | 50 g/lit. |
| boric acid | 30 g/lit. |
| <Plating conditions> | |
| pH | 4.0 |
| bath temperature | 50° C. |
| current density (Dk) | 5 A/dm$^2$. |

The obtained basis material for watch band covered with the nickel plating layer was immersed in a plating solution of the following composition and electroplated under the following conditions. Thus, a 3 μm thick palladium/nickel alloy plating layer (palladium content: 65% by weight) was formed on a surface of the nickel plating layer.

<<Palladium/nickel Alloy Plating>>

| <Composition of plating solution> | |
|---|---|
| palladium chloride | 10 g/lit. |
| nickel sulfamate | 15 g/lit. |
| ammonium chloride (electro-conductive salt) | 60 g/lit. |
| brightener | 10 ml/lit. |
| pit preventive agent | 3 ml/lit. |
| <Plating conditions> | |
| pH | 8.2 |
| bath temperature | 35° C. |
| current density (Dk) | 1 A/dm$^2$. |

The above brightener and pit preventive agent are commercially available from Chuo Kagaku Sangyo K. K. by the trade name "Precious SCX 53" and "Precious SCX 55", respectively.

Thereafter, a 0.3 μm thick titanium nitride coating layer was formed by ion plating on a surface of the palladium/nickel alloy plating layer. As a result, a watch band covered with a golden colored coating was obtained.

The artificial sweat immersion test and ammonia gas corrosion and cracking test of the obtained watch band were carried out in the above manner. The results are given in Table 1.

TABLE 1

| | Example | | | Comp. Ex. |
|---|---|---|---|---|
| | 1 | 2 | 3 | 1 |
| P content of Ni/P plating layer (wt. %) | 12 | 14 | 14 | — |
| Pd content of Pd/Ni plating layer (wt. %) | — | — | — | 65 |
| art. sweat immersion test | pass | pass | pass | pass |
| ammonia gas corrosion and cracking test | pass | pass | pass | fail |

What is claimed is:

1. A personal ornament having its surface covered with a colored coating formed by dry-plating comprising:

a basis material for the personal ornament, composed of a copper alloy or zinc, a nickel plating layer on a surface of the basis material, or a nickel plating layer on a surface of a copper plating layer on a surface of the basis material, a completely amorphous nickel/phosphorus alloy plating layer on a surface of the nickel plating layer, and at least one colored coating layer on a surface of the amorphous nickel/phosphorus alloy plating layer, the colored coating layer formed by dry-plating, said amorphous nickel/phosphorus alloy plating layer formed by electroplating or by electroless plating and having a phosphorus content of 12 to 16% by weight.

2. A personal ornament having its surface covered with a colored coating formed by dry-plating comprising:

a basis material for the personal ornament, composed of a copper alloy or zinc, a nickel plating layer on a surface of the basis material, or a nickel plating layer on a surface of a copper plating layer on a surface of the basis material, a completely amorphous nickel/phosphorus alloy plating layer on a surface of the nickel plating layer, said amorphous nickel/phosphorus alloy plating layer formed in a plating solution which contains nickel sulfate in an amount, in terms of nickel atom, of 15 to 70 g/lit., sodium hypophosphite in an amount, in terms of phosphorus atom, of 10 to 50 g/lit., an electric conductive salt in an amount of 50 to 90 g/lit., a pH buffer in an amount of 20 to 50 g/lit. and a complexing agent in an amount of 5 to 30 g/lit., and at least one colored coating layer on a surface of the amorphous nickel/phosphorus alloy plating layer, the colored coating layer formed by dry-plating, said amorphous nickel/phosphorus alloy plating layer formed by electroplating or by electroless plating, and having a phosphorus content of 12 to 16% by weight.

3. The personal ornament as claimed in claim 2, wherein the amorphous nickel/phosphorus alloy plating layer is one obtained by electroplating at a current density (Dk) of 1 to 3 A/dm$^2$ in said plating solution whose pH is in the range of 3.0 to 3.5 and whose temperature is in the range of 50 to 60° C.

4. The personal ornament as claimed in claim 2, wherein the complexing agent is at least one member selected from the group consisting of citric acid, tartaric acid, malonic acid, malic acid, glycine, gluconic acid and salts thereof.

5. A personal ornament having its surface covered with a colored coating, the colored coating formed by dry-plating, which personal ornament comprises:

a basis material for the personal ornament, composed of a copper alloy or zinc, a nickel plating layer on a surface of the basis material, or a nickel plating layer on a surface of a copper plating layer on a surface of the basis material, a completely amorphous nickel/phosphorus alloy plating layer on a surface of the nickel plating layer, said amorphous nickel/phosphorus alloy plating layer formed by electroless plating in a plating solution which contains a nickel salt in an amount, in terms of nickel atom, of 1 to 15 g/lit., sodium hypophosphite (reducing agent) in an amount, in terms of phosphorus atom, of 5 to 30 g/lit., a complexing agent, a buffer and a pH regulator, or by first electroplating in the plating solution and thereafter electroless plating in the same plating solution, and at least one colored coating layer on a surface of the amorphous nickel/phosphorus alloy plating layer, the colored coating layer formed by dry-plating, said amorphous nickel/phosphorus alloy plating layer formed by electroplating or by electroless plating and having a phosphorus content of 12 to 16% by weight.

6. The personal ornament as claimed in claim 5, wherein the plating solution for use in the electroless plating or in the electroplating followed by the electroless plating has a pH of 3.0 to 4.5 and a temperature of 50 to 95° C.

7. The personal ornament as claimed in claim 1, wherein the colored coating layer is at least one layer selected from the group consisting of a metal coating layer, a coating layer of metal nitride, a coating layer of metal carbide, a coating layer of metal oxide, a coating layer of metal carbonitride, a coating layer of metal oxynitride, a coating layer of metal oxycarbide and a coating layer of metal oxycarbonitride.

8. The personal ornament as claimed in claim 1, wherein the nickel plating layer has a thickness of 1 to 10 μm, the amorphous nickel/phosphorus alloy plating layer has a thickness of 3 to 5 μm, and the colored coating layer has a thickness of 0.1 to 2 μm.

9. A process for producing a personal ornament having its surface covered with a colored coating, the colored coating formed by dry-plating, which process comprises the steps of:

electroplating a surface of a basis material for the personal ornament composed of a copper alloy or zinc to thereby form a nickel plating layer on the surface, or first electroplating a surface of the basis material to thereby form a copper plating layer on the surface and thereafter electroplating a surface of the copper plating layer to thereby form a nickel plating layer on the surface of the copper plating layer, electroplating a surface of the nickel plating layer in a plating solution which contains nickel sulfate in an amount, in terms of nickel atom, of 15 to 70 g/lit., sodium hypophosphite in an amount, in terms of phosphorus atom, of 10 to 50 g/lit., an electric conductive salt in an amount of 50 to 90 g/lit., a pH buffer in an amount of 20 to 50 glit. and a complexing agent in an amount of 5 to 30 g/lit. to thereby form on the surface of the nickel plating layer a completely amorphous nickel/phosphorus alloy plating layer formed by electroplating or by electroless plating and having a phosphorus content of 12 to 16% by weight, and subjecting a surface of the amorphous nickel/phosphorus alloy plating layer to dry-plating so that at least one colored coating layer is formed on the surface.

10. The process as claimed in claim 9, wherein the formation of the amorphous nickel/phosphorus alloy plating layer is performed at a current density (Dk) of 1 to 3 A/dm2 in the plating solution whose temperature is in the range of 50 to 60° C.

11. The process as claimed in claim 9, wherein the complexing agent is at least one member selected from the group consisting of citric acid, tartaric acid, malonic acid, malic acid, glycine, gluconic acid and salts thereof.

12. A process for producing a personal ornament having its surface covered with a colored coating, the colored coating formed by dry-plating, which process comprises the steps of:

electroplating a surface of a basis material for the personal ornament composed of a copper alloy or zinc to thereby form a nickel plating layer on the surface, or first electroplating a surface of the basis material to thereby form a copper plating layer on the surface and thereafter electroplating a surface of the copper plating layer to thereby form a nickel plating layer on the surface of the copper plating layer, electroless plating a surface of the nickel plating layer in a plating solution which contains a nickel salt in an amount, in terms of nickel atom, of 1 to 15 g/lit., sodium hypophosphite (reducing agent) in an amount, in terms of phosphorus atom, of 5 to 30 gilit., a complexing agent, a buffer and a pH regulator, or first electroplating a surface of the nickel plating layer in the plating solution and thereafter electroless plating the surface in the same plating solution, to thereby form on the surface of the nickel plating layer a completely amorphous nickel/phosphorus alloy plating layer formed by electroplating or by electroless plating and having a phosphorus content of 12 to 16% by weight, and subjecting a surface of the amorphous nickel/phosphorus alloy plating layer to dry-plating so that at least one colored coating layer is formed on the surface.

13. The process as claimed in claim 12, wherein the amorphous nickel/phosphorus alloy plating layer is formed by electroless plating in the plating solution whose pH is in the range of 3.0 to 4.5 and whose temperature is in the range of 85 to 95° C.

14. The process as claimed in claim 12, wherein the amorphous nickel/phosphorus alloy plating layer is formed by first electroplating by passing current at a density (Dk) of 0.5 to 3 A/dm$^2$ for a period of 5 to 30 sec through the plating solution whose pH value is in the range of 3.0 to 4.5 and whose temperature is in the range of 50 to 95° C. and thereafter electroless plating in the plating solution.

15. The process as claimed in claim 9, wherein the colored coating layer is at least one layer selected from the group consisting of a metal coating layer, a coating layer of metal nitride, a coating layer of metal carbide, a coating layer of metal oxide, a coating layer of metal carbonitride, a coating layer of metal oxynitride, a coating layer of metyal oxycarbide and a coating layer of metal oxycarbonitride.

16. The process as claimed in claim 9, wherein the nickel plating layer has a thickness of 1 to 10 μm, the amorphous nickel phosphorus plating layer has a thickness of 3 to 5 μm, and the colored coating layer has a thickness of 0.1 to 2 μm.

17. The personal ornament as claimed in claim 2, wherein the colored coating layer is at least one layer selected from the group consisting of a metal coating layer, a coating layer of metal nitride, a coating layer of metal carbide, a coating layer of metal oxide, a coating layer of metal carbonitride, a coating layer of metal oxynitride, a coating layer of metal oxycarbide and a coating layer of metal oxycarbonitride.

18. The personal ornament as claimed in claim 5, wherein the colored coating layer is at least one layer selected from the group consisting of a metal coating layer, a coating layer of metal nitride, a coating layer of metal carbide, a coating layer of metal oxide, a coating layer of metal carbonitride, a coating layer of metal oxynitride, a coating layer of metal oxycarbide and a coating layer of metal oxycarbonitride.

19. The personal ornament as claimed in claim 2, wherein the nickel plating layer has a thickness of 1 to 10 μm, the amorphous nickel/phosphorus alloy plating layer has a thickness of 3 to 5 μm, and the colored coating layer has a thickness of 0.1 to 2 μm.

20. The personal ornament as claimed in claim 5, wherein the nickel plating layer has a thickness of 1 to 10 μm, the amorphous nickel/phosphorus alloy plating layer has a thickness of 3 to 5 μm, and the colored coating layer has a thickness of 0.1 to 2 μm.

21. The process as claimed in claim 12, wherein the colored coating layer is at least one layer selected from the group consisting of a metal coating layer, a coating layer of metal nitride, a coating layer of metal carbide, a coating layer of metal oxide, a coating layer of metal carbonitride, a coating layer of metal oxynitride, a coating layer of metal oxycarbide and a coating layer of metal oxycarbonitride.

22. The process as claimed in claim 12, wherein the nickel plating layer has a thickness of 1 to 10 $\mu$m, the amorphous nickel/phosphorus plating layer has a thickness of 3 to 5 $\mu$m, and the colored coating layer has a thickness of 0.1 to 2 $\mu$m.

23. The personal ornament as claimed in claim 1, wherein the nickel/phosphorus alloy plating layer has a thickness of 3 to 5 $\mu$m.

24. The personal ornament as claimed in claim 2, wherein the nickel/phosphorus alloy plating layer has a thickness of 3 to 5 $\mu$m.

25. The personal ornament as claimed in claim 5, wherein the nickel/phosphorus alloy plating layer has a thickness of 3 to 5 $\mu$m.

26. The process as claimed in claim 9, wherein the nickel/phosphorus alloy plating layer has a thickness of 3 to 5 $\mu$m.

27. The process as claimed in claim 12, wherein the nickel/phosphorus alloy plating layer has a thickness of 3 to 5 $\mu$m.

28. The personal ornament as claimed in claim 1, wherein said amorphous nickel/phosphorus alloy plating layer has a phosphorus content of 14 to 16% by weight.

29. The personal ornament as claimed in claim 2, wherein said amorphous nickel/phosphorus alloy plating layer has a phosphorus content of 14 to 16% by weight.

30. The personal one ornament as claimed in claim 5, wherein said amorphous nickel/phosphorus alloy plating layer has a phosphorus content of 14 to 16% by weight.

31. The process as claimed in claim 9, wherein said amorphous nickel/phosphorus alloy plating layer has a phosphorus content of 14 to 16% by weight.

32. The process as claimed in claim 9, wherein said amorphous nickel/phosphorus alloy plating layer has a phosphorus content of 14 to 16% by weight.

33. The process as claimed in claim 12, wherein said amorphous nickel/phosphorus alloy plating layer has a phosphorus content of 14 to 16% by weight.

* * * * *

UNITED STATES PATENT AND TRADEMARK OFFICE

CERTIFICATE OF CORRECTION

PATENT NO. : 6,413,653 B1
DATED : July 2, 2002
INVENTOR(S) : Takeshi Araki et al.

It is certified that error appears in the above-identified patent and that said Letters Patent is hereby corrected as shown below:

Column 2,
Line 51, "completing agent" should read -- complexing agent --.

Column 3,
Line 25, "aspect o f " should read -- aspect of --.

Column 5,
Line 7, "completing" should read -- complexing --.
Line 41, "completing agent" should read -- complexing agent --.

Column 7,
Line 38, "10 μm. preferably" should read -- 10 μm, preferably --.

Column 12,
Line 67, "completing agent" should read -- complexing agent --.

Column 17,
Line 41, "20 to 50 glit." should read -- 20 to 50 g/lit. --.

Column 18
Line 9, "5 to 30 gilit.," should read -- 5 to 30 g/lit., --.
Line 42, "nickel phosphorus" should read -- nickel/phosphorus --.

Column 20,
Line 10, "The personal one ornament" should read -- The personal ornament --.

Signed and Sealed this

Fourteenth Day of January, 2003

JAMES E. ROGAN
*Director of the United States Patent and Trademark Office*